US009964105B2

(12) United States Patent
Reinhard et al.

(10) Patent No.: US 9,964,105 B2
(45) Date of Patent: May 8, 2018

(54) DIAPHRAGM PUMP HAVING POSITION CONTROL

(71) Applicant: ProMinent GmbH, Heidelberg (DE)

(72) Inventors: Martin Reinhard, Heidelberg (DE); Christian Arnold, Weinheim (DE)

(73) Assignee: ProMinent GmbH, Heidelberg (DE)

( * ) Notice: Subject to any disclaimer, the term of this patent is extended or adjusted under 35 U.S.C. 154(b) by 255 days.

(21) Appl. No.: 14/783,996

(22) PCT Filed: May 12, 2014

(86) PCT No.: PCT/EP2014/059614
§ 371 (c)(1),
(2) Date: Oct. 12, 2015

(87) PCT Pub. No.: WO2014/184125
PCT Pub. Date: Nov. 20, 2014

(65) Prior Publication Data

US 2016/0069341 A1 Mar. 10, 2016

(30) Foreign Application Priority Data

May 16, 2013 (DE) ..... 10 2013 105 072

(51) Int. Cl.
*F04B 43/073* (2006.01)
*F04B 43/06* (2006.01)
*F04B 43/067* (2006.01)

(52) U.S. Cl.
CPC ..... *F04B 43/073* (2013.01); *F04B 43/06* (2013.01); *F04B 43/067* (2013.01)

(58) Field of Classification Search
CPC ..... F04B 43/073; F04B 43/06; F04B 43/067
See application file for complete search history.

(56) References Cited

U.S. PATENT DOCUMENTS 2,993,446 A 7/1961 Pleuger
3,769,879 A * 11/1973 Lofquist, Jr. ..... F04B 39/044 417/386

(Continued)

FOREIGN PATENT DOCUMENTS

CN 101743403 A 6/2010
CN 201635971 U 11/2010

(Continued)

OTHER PUBLICATIONS

The State Intellectual Property Off of the People's Repulblic of China, Application No. 201480027675.3, Notice on the First Office Action, dated Nov. 2, 2016 (English translation).

(Continued)

*Primary Examiner* — Kenneth J Hansen
(74) *Attorney, Agent, or Firm* — Paul & Paul

(57) ABSTRACT

A diaphragm pump includes a pumping chamber, suction and pressure connections, a working chamber filled with a hydraulic fluid, a device for applying an oscillating pressure P1 to the hydraulic fluid, and a diaphragm separating the pumping chamber and the working chamber moveable between a pressure stroke position and a suction stroke position. A storage chamber accommodates hydraulic fluid at a pressure P2. The storage chamber and the working chamber are connected to each other by a valve having a closing part. The diaphragm cannot move too far beyond the pressure stroke position. The diaphragm is coupled to the closing part so that the valve is opened when the diaphragm moves from the pressure stroke position to a position that is farther from the suction stroke position than the pressure stroke position.

9 Claims, 5 Drawing Sheets

(56) References Cited

U.S. PATENT DOCUMENTS

Figure 1:
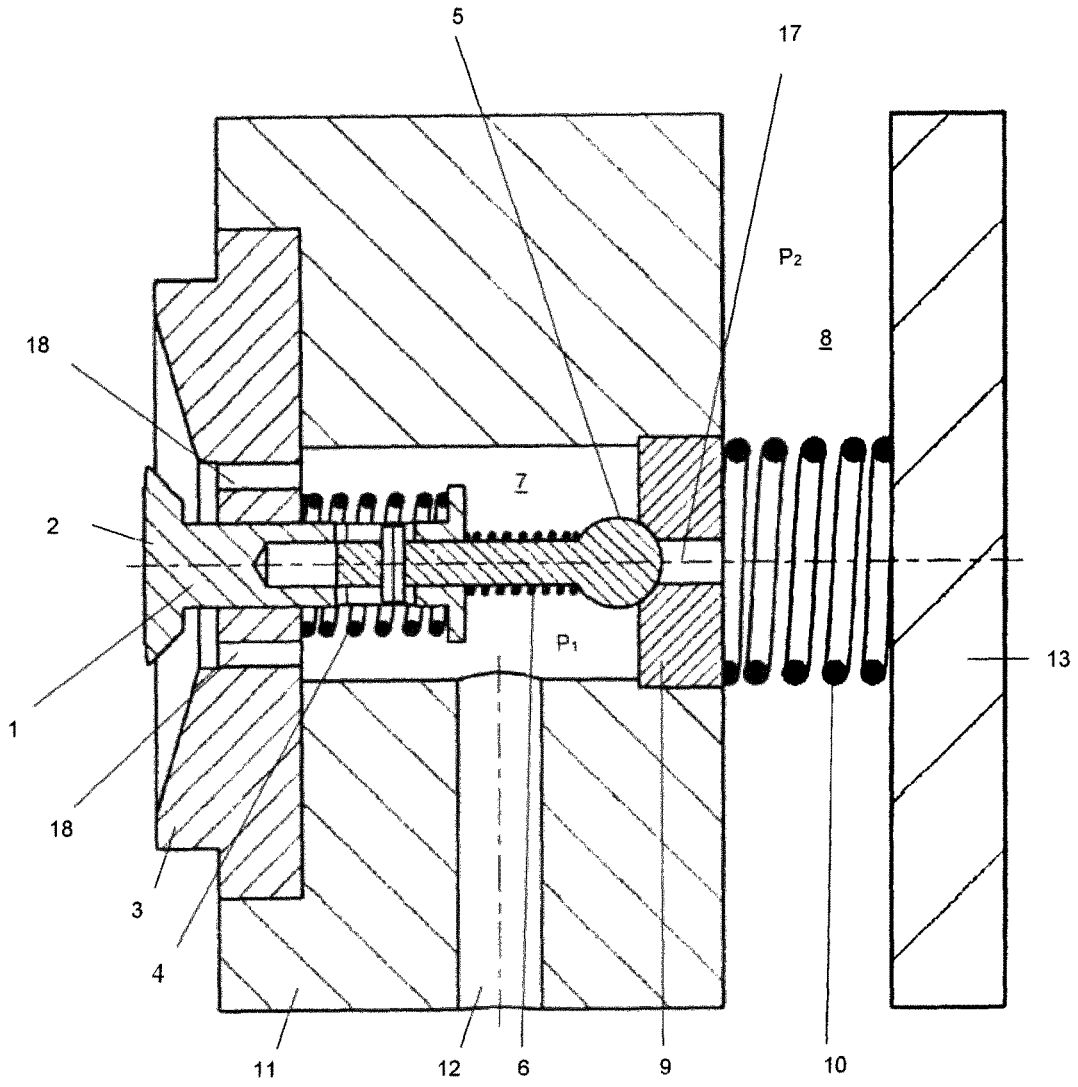

| | | | |
|---|---|---|---|
| 5,246,351 | A | 9/1993 | Horn |
| 7,665,974 | B2 | 2/2010 | Hembree |
| 2013/0209280 | A1 | 8/2013 | Fritsch |

FOREIGN PATENT DOCUMENTS

| | | | |
|---|---|---|---|
| DE | 23 33 876 | A1 | 1/1975 |
| DE | 28 43 054 | A | 4/1980 |
| DE | 10 2010 039829 | A1 | 3/2012 |
| EP | 0547404 | A1 | 11/1992 |
| JP | H03 149 371 | A | 6/1991 |

OTHER PUBLICATIONS

Nora Linder, "International Preliminary Report on Patentability" PCT/EP2014/059614, World Intellectual Property Organization, dated Nov. 19, 2015.

* cited by examiner

DIAPHRAGM PUMP HAVING POSITION CONTROL

CROSS-REFERENCE TO RELATED APPLICATION

This application is a 371 national stage application of International Application PCT/EP2014/059614, filed May 12, 2014, and claims the priority of German Application No. 10 2013 105 072.7, filed on May 16, 2013.

The present invention concerns a hydraulically driven diaphragm pump. Such diaphragm pumps have a conveyor chamber, a suction connection and a pressure connection which are both connected to the conveyor chamber, a working chamber which is filled with a hydraulic fluid, a device for applying an oscillating pressure $p_1$ to the hydraulic fluid, a diaphragm which separates the conveyor chamber and the working chamber from each other and which is reciprocable between a pressure stroke position and a suction stroke position, wherein the volume of the conveyor chamber in the pressure stroke position of the diaphragm is smaller than in the suction stroke position of the diaphragm, a storage chamber for accommodating hydraulic fluid at the pressure $p_2$, wherein the storage chamber and the working chamber are connected together by way of a valve having a closing portion.

In operation the suction connection and the pressure connection are respectively connected by way of non-return valves to a suction conduit and a pressure conduit respectively.

The diaphragm can be resiliently biased in the direction of the suction stroke position. The diaphragm will assume a position in which the forces acting on the diaphragm, that is to say the force applied by the fluid pressure in the conveyor chamber and optionally by the resilient biasing in the direction of the suction stroke position on the one hand and the force applied by the fluid pressure in the working chamber in the direction of the pressure stroke position on the other hand cancel each other out.

If therefore the fluid pressure in the working chamber is reduced and accordingly becomes less than the pressure in the conveyor chamber that leads to movement of the diaphragm in the direction of the suction stroke position. Due to the increase in the conveyor chamber volume that is linked thereto the pressure in the conveyor chamber also decreases. If the fluid pressure in the conveyor chamber falls below a value predetermined by the pressure in the suction conduit (generally ambient pressure) and the non-return valve the non-return valve opens to the suction conduit and delivery fluid is sucked out of the suction conduit into the conveyor chamber by way of the suction connection.

If on the other hand the pressure in the working chamber increases then the diaphragm is moved from the suction stroke position in the direction of the pressure stroke position whereby the pressure in the conveyor chamber is increased and the delivery fluid in the conveyor chamber is pressed into the pressure conduit by way of the pressure connection.

The application of an oscillating pressure to the hydraulic fluid thus leads to an oscillating movement of the diaphragm and linked thereto an oscillating pumping process for the delivery fluid from the suction conduit into the pressure conduit.

Such hydraulically driven diaphragm pumps are used in particular in the delivery of fluid under very high pressures as the diaphragm is uniformly loaded by the hydraulic fluid and has a longer service life.

Acting on the hydraulic fluid with an oscillating pressure is generally implemented by means of a moving piston. Even in regard to the best machining of the individual moveable parts nonetheless there can be a bypass flow with hydraulic fluid around the piston so that the amount of fluid in the working chamber differs from the optimum amount, which means that either the diaphragm is moved beyond the pressure stroke position, which can lead to perforation or destruction of the diaphragm, or the diaphragm no longer reaches the pressure stroke position, whereby the delivery volume per stroke is reduced. Both are unwanted.

EP 0 547 404 describes a hydraulically driven diaphragm pump. In that pump the working chamber is connected to the storage chamber by way of a leak make-up valve. If the pressure in the working chamber falls below a predetermined hydraulic pressure the leak make-up valve opens and hydraulic fluid can further flow from the working chamber into the storage chamber. In addition the diaphragm in EP 0 547 404 is connected to a control slider which, in the situation where the diaphragm moves away from the suction stroke position beyond the pressure stroke position, is connected to a valve member which interrupts the hydraulic communication from the part of the working chamber in which the piston producing the oscillating pressure is arranged and the part of the working chamber in which the diaphragm is arranged.

That structure however is relatively complicated and is also susceptible to faults if, by virtue of the design configuration of the valve element, hydraulically sealing separation of the piston from the diaphragm working chamber is not guaranteed. In addition, it is necessary to provide in the part of the working chamber in which the piston is disposed, an additional pressure relief valve which permits the hydraulic fluid to escape in the event of closure of the communication to the diaphragm working chamber with the valve member.

Therefore, taking the described state of the art as the basic starting point, the object of the present invention is to provide a diaphragm pump of the kind set forth in the opening part of this specification, which is of a simple structure and reliably ensures that the diaphragm cannot move too far beyond the pressure stroke position.

According to the invention that object is attained in that the diaphragm is coupled to the closing portion in such a way that upon a movement of the diaphragm from the pressure stroke position into a position which is further away from the suction stroke position the valve is opened.

If therefore, because for example there is too much hydraulic fluid in the working chamber, the diaphragm should move beyond the pressure stroke position, the coupling of the diaphragm to the closing element leads to valve opening and hydraulic fluid can escape from the working chamber into the storage chamber, which leads to a marked reduction in the pressure in the working chamber and therefore prevents a further movement of the diaphragm beyond the pressure stroke position. Instead, by virtue of the drop in pressure in the working chamber, the diaphragm will move back in the direction of the pressure stroke position again, whereby the valve is closed again by virtue of the diaphragm being coupled to the closing portion.

That measure ensure that a movement of the diaphragm markedly beyond the pressure stroke position into a position which is further away from the suction stroke position is reliably prevented.

For example there can be provided a tie rod fixed to the diaphragm, the closing portion being connected to the tie rod.

In a preferred embodiment it is provided that the closing portion is moveably fixed to the tie rod so that the closing portion can be reciprocated relative to the tie rod between two positions which are such that in the pressure stroke position of the diaphragm when the closing portion is in the first position the valve is closed and in the second position of the closing portion the valve is opened.

In a further preferred embodiment the closing portion is biased resiliently into the first position.

By virtue of that measure therefore the diaphragm can perform a certain movement without the closing portion opening the valve. It is only when the diaphragm passes into a position which is further away from the suction stroke position than the pressure stroke position that the closing portion is moved out of the valve seat by virtue of the mechanical connection to the diaphragm so that the valve is opened.

In a further preferred embodiment the resilient biasing of the closing portion is of such a magnitude that, when $p_2-p_1>a$ applies for the pressure difference between the pressure in the storage chamber and the pressure in the working chamber, wherein a is a predetermined pressure, the closing portion is moved from the first position in the direction of the second position and the valve is opened. In that case a is determined by the choice of the spring constant of the resilient biasing.

That measure ensures that, in the event of fluid loss in the working chamber, fluid can be refilled from the storage chamber as soon as the pressure in the working chamber drops below a predetermined value.

In a further preferred embodiment the diaphragm is resiliently biased in the direction of the suction stroke, wherein that is preferably caused by a resiliently biased tie rod.

By virtue of that measure the return movement of the diaphragm from the pressure stroke position into the suction stroke position is ensured even when there is no or an excessively low delivery fluid pressure in the conveyor chamber. In most situations of use the pump must suck in delivery fluid at the suction connection so that then the fluid pressure in the conveyor chamber drops and the biasing is required to move the diaphragm in the direction of the suction stroke.

A further preferred embodiment provides that the working chamber is arranged in a housing, wherein the housing has a wall element with a passage to the storage chamber and a valve seat, wherein preferably the wall element is arrange moveably in an opening in the housing.

In other words the valve can be opened even without movement of the closing portion, insofar as the wall element and therewith the valve seat are moved relative to the closing portion.

The additional provision of a pressure relief valve can be avoided by virtue of the moveable arrangement of the wall element and thus the valve seat. If the pressure in the working chamber should rise too greatly, that will lead a movement of the wall element and thus the valve seat in the opening, which has the consequence that the closing portion is moved out of the valve seat and thus the valve is opened so that the pressure in the working chamber decreases again due to the communication with the storage chamber.

Preferably the wall element is resiliently biased in the direction of the housing opening, wherein preferably arranged in the opening is an abutment element towards which the wall element is resiliently biased.

In that respect the resilient biasing of the wall element is advantageously of such a magnitude that, when $p_1-p_2>b$ applies for the pressure difference between the pressure in the working chamber and the pressure in the storage chamber, wherein b is a predetermined pressure, the wall element moves away from the closing portion and as a result the valve opens.

Figure 2:
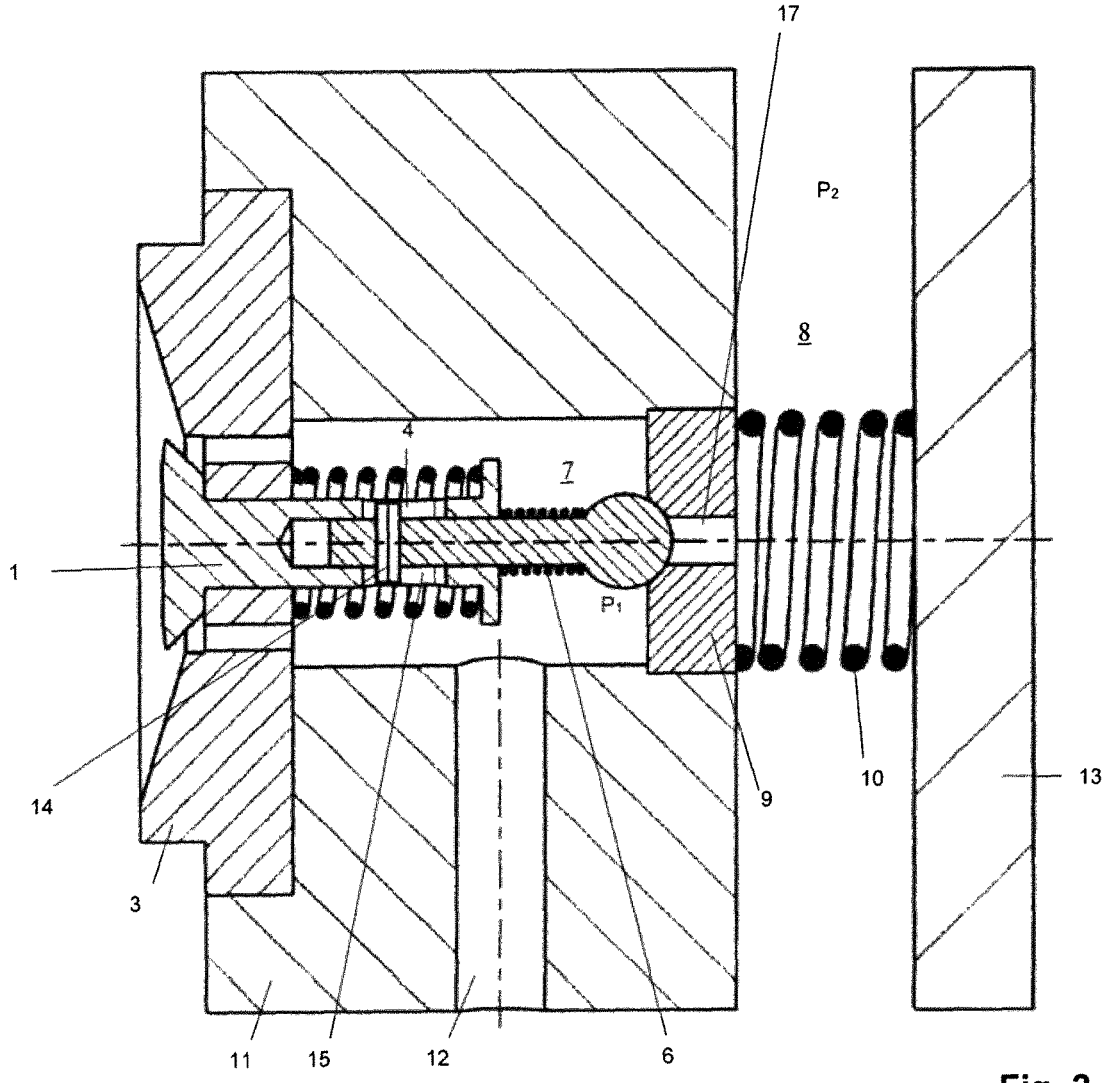
Figure 3:
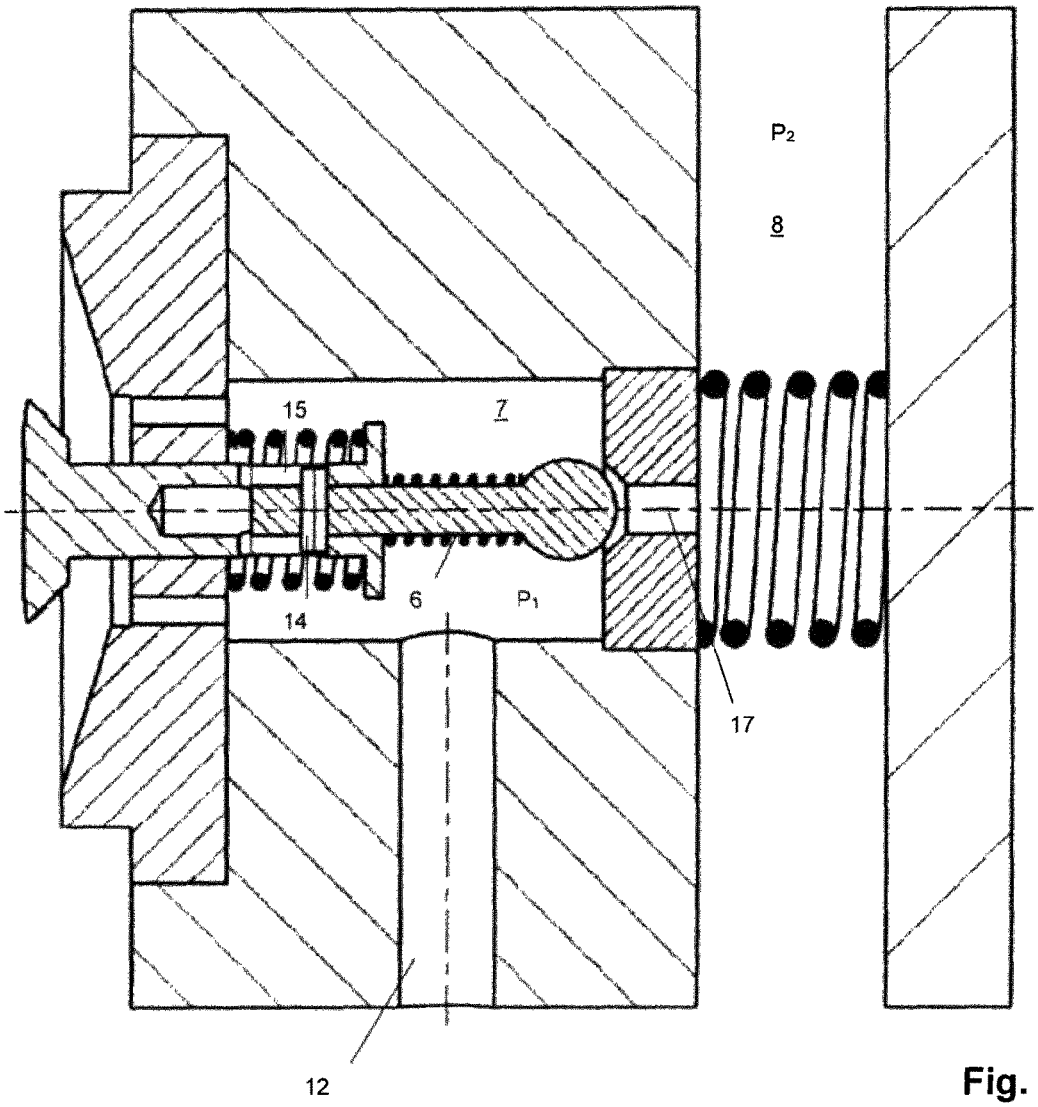
Figure 4:
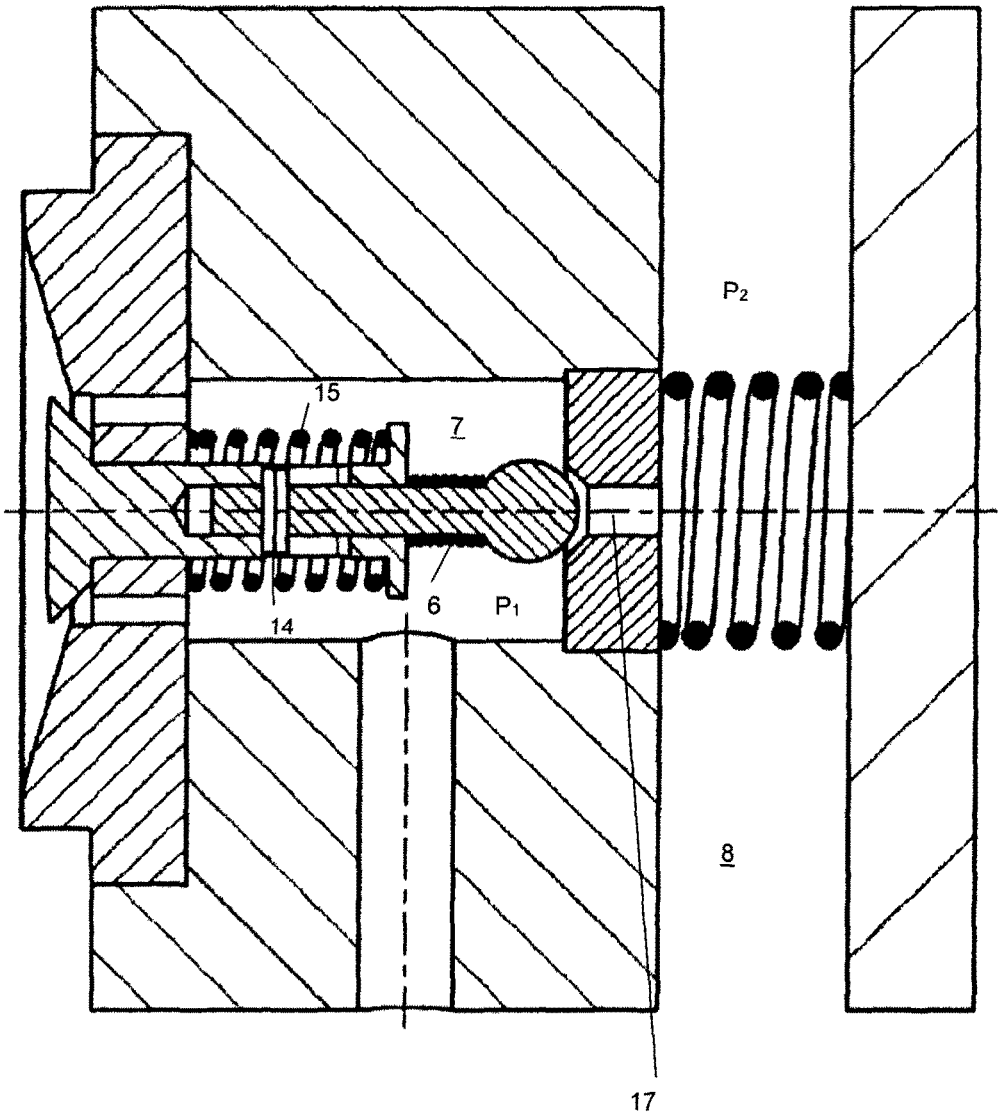
Figure 5:
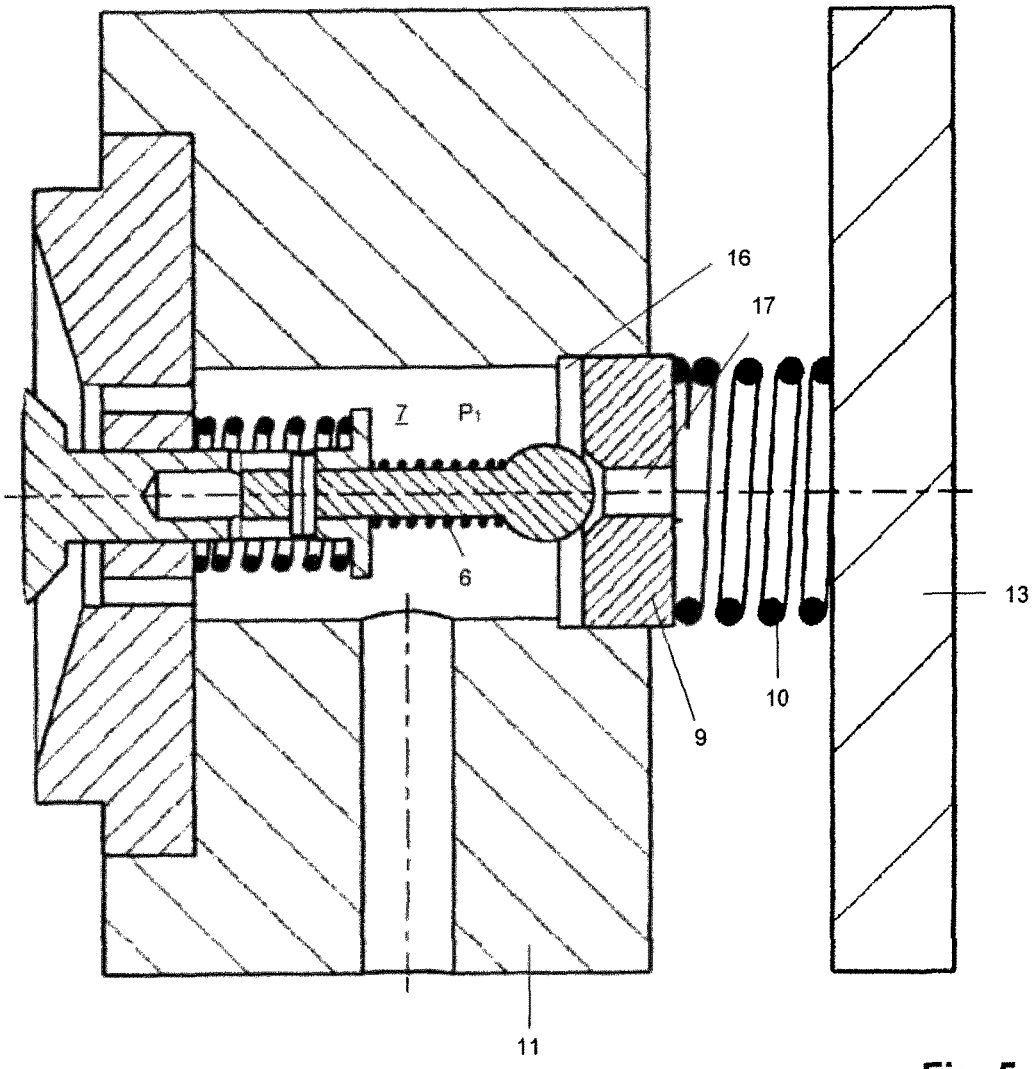

Further advantages, features and possible uses of the present invention will be apparent from the description hereinafter of a preferred embodiment. In the drawings:

FIG. 1 shows a diagrammatic view of an implementation position according to the invention of a diaphragm pump in the pressure stroke position, FIG. 2 shows a diagrammatic view of an implementation position according to the invention of a diaphragm pump in the suction stroke position, FIG. 3 shows a diagrammatic view for the situation where there is too much hydraulic fluid in the working chamber, FIG. 4 shows a diagrammatic view for the situation where there is too little hydraulic fluid in the working chamber, and FIG. 5 shows a diagrammatic view to illustrate the pressure relief function.

FIG. 1 is a diagrammatic view of a part of a diaphragm pump. The diaphragm pump according to the invention has a conveyor chamber (not shown), a suction connection (not shown) connected to the conveyor chamber and a pressure connection (not shown). A working chamber 7 is filled with a hydraulic fluid. The hydraulic fluid can be acted upon with an oscillating pressure $p_1$ by way of the passage 12.

Also provided is a diaphragm (not shown) separating the conveyor chamber and the working chamber 7 from each other. The diaphragm is clamped between the conveyor chamber housing (not shown) and the component 3. That diaphragm is held in its position by means of the head 2 of a tie rod 1. The conveyor chamber is then at the left of the head 2 of the tie rod 1 in FIG. 1.

FIG. 1 shows the tie rod 1 in its pressure stroke position, that is to say this is the position that the tie rod 1 and thus the diaphragm should assume at the end of the pressure stroke. That position is normally reached by the pressure $p_1$ in the working chamber 7 being increased so that the pressurized fluid exerts pressure by way of the passages 18 on the diaphragm connected to the head 2 of the tie rod 1 and urges it in the direction of the conveyor chamber, that is to say towards the left in FIG. 1.

The tie rod 1 and thus the diaphragm connected to the tie rod 1 by way of the head 2 is resiliently biased in the direction of the suction stroke, that is to say towards the right in FIG. 1, by means of the spring 4 which is supported on the one hand against the component 3 and on the other hand against a collar-shaped enlargement on the tie rod 1. When therefore the pressure $p_1$ in the working chamber 7 drops the spring 4 provides that the tie rod 1 and therewith the diaphragm are moved in the direction of the suction stroke whereby the volume in the conveyor chamber is increased. The corresponding suction stroke position is shown in FIG. 2. In that position the diaphragm (not shown) bears against the conical surfaces of the component 3.

Due to the oscillating pressure which is transmitted to the working chamber 7 by way of the passage 12 the tie rod 2 moves alternately in opposite relationship to the spring force of the spring 4 in the direction of the pressure stroke position (shown in FIG. 1) and by virtue of the spring force of the spring 4 in the direction of the suction stroke position (shown in FIG. 2).

Optimum functioning of the diaphragm pump is ensured only when the correct amount of hydraulic fluid is present in the working chamber 7 as it is only then that the diaphragm and therewith the tie rod 2 completely perform the desired movement.

The tie rod 2 is connected to a closing portion 5 cooperating with a valve seat in the wall element 9. The wall element 9 has a communication 17 by way of which the working chamber 7 communicates with a storage chamber 8 in which hydraulic fluid is filled at the pressure $p_2$ (that is substantially the ambient pressure).

In the pressure stroke position and suction stroke position shown in FIGS. 1 and 2 the closing element 5 is positioned in the valve seat of the wall element 9 during regular operation of the pump so that the communication 17 between the working chamber 7 and the storage chamber 8 is closed. To ensure this the closing element 5 is arranged moveably in the tie rod 1. For that purpose the tie rod has suitable slots 15 into which engages a pin 14 fixed to the closing element 5. That structure provides that the closing element 5 can be reciprocated in the longitudinal direction relative to the tie rod 1 between two positions. Those positions are so selected that, upon a movement between pressure stroke and suction stroke, that is to say upon a movement between the two usual extreme positions shown in FIGS. 1 and 2, the closing element 5 can hold the communication 17 between the working chamber 7 and the storage chamber 8 closed. In order reliably to ensure this there is additionally provided a spring 6 which urges the closing element in the direction of the wall element 9, that is to say in the direction of the valve seat. For that purpose the spring 6 bears against the tie rod 1.

By virtue of leaks which are always present however it can happen that there is too much hydraulic fluid in the working chamber 7. The result of this is that the diaphragm moves beyond the pressure stroke position shown in FIG. 1 further from the suction stroke position shown in FIG. 2. That is undesirable as it can lead to damage to or even destruction of the diaphragm.

In the illustrated embodiment a movement of the diaphragm beyond the pressure stroke position leads to the situation shown in FIG. 3. As the diaphragm and thus the tie rod 1 have moved too far towards the left the illustrated structure provides that the pin 14 connected to the closing element comes into abutment in the slot 15 at one side and, by virtue of the movement of the diaphragm towards the left, the closing element 5 is lifted out of the valve seat in the wall element 9. By virtue of that measure the communication 17 between the working chamber 7 and the storage chamber 8 is opened and fluid can issue from the working chamber 7 into the storage chamber 8. That takes place until the pressure $p_1$ has dropped again, that is to say until the excess amount of fluid has flowed away into the storage chamber by way of the communication 17 so that the spring 4 is again in the position of moving the diaphragm back into the pressure stroke position.

In principle the situation can also occur where too little hydraulic fluid is contained in the working chamber 7. This then has the result that the pump can no longer reach the pressure stroke position shown in FIG. 1 and therefore the intended amount of fluid can no longer be delivered in each pump stroke. In addition too little hydraulic fluid in the working chamber 7 means that the pressure $p_1$ in the working chamber drops severely at least at the end of the suction stroke, that is to say substantially in the suction stroke position shown in FIG. 2. Such a pressure drop admittedly does not have any negative effects on the pump operation but can be used to provide for leak make-up.

As can be seen from FIG. 4 a drop in the pressure $p_1$ below a predetermined value has the result however that the fluid pressure $p_2$ prevailing in the storage chamber 8 is in a position of lifting the closing element 5 out of the valve seat against the force of the spring 6 so that in this situation also the communication 17 between the working chamber 7 and the storage chamber 8 is opened and fluid flows out of the storage chamber 8 into the working chamber 7 until there the pressure rises again and the spring 6 provides that the closing element 5 closes the communication 17 again.

Finally, it can happen with the described diaphragm pumps that for some reason the pressure on the pressure conduit increases greatly so that it is no longer possible to move the diaphragm to the pressure stroke position shown in FIG. 1 with the oscillating pressure $p_1$ in the working chamber 7. Instead, the pressure $p_1$ in the working chamber 7 rises greatly, which can also lead to damage to the diaphragm. For that reason, in the illustrated embodiment it is provided that the wall element 9 in which the passage 17 with valve seat is incorporated can move in an opening in the housing 11 of the working chamber 7. A spring 10 which is supported on the one hand against the storage chamber housing 13 and on the other hand against the wall element 9 provides that the wall element 9 is urged into the opening in the working chamber housing 11 in the direction of an abutment 16. If now however a situation is reached in which the pressure $p_1$ in the working chamber 7 exceeds a predetermined value, although the pressure stroke position has not yet been reached at all, the result of this is that the wall element 9 is moved away from the abutment 16 against the force of the spring 10 and thereby the closing element 5 comes out of engagement with the valve seat and the communication 17 between the working chamber 7 and the storage chamber 8 is opened, whereby the increased pressure $p_1$ in the working chamber can be relieved. As a result the diaphragm moves into its suction stroke position shown in FIG. 2. As the diaphragm bears against the conical surfaces of the element 3 in that position the diaphragm is protected.

LIST OF REFERENCES

1 tie rod
2 head
3 component
4 spring
5 closing element
6 spring
7 working chamber
8 storage chamber
9 wall element
10 spring
11 housing
12 passage
13 storage chamber housing
14 pin
15 slot
16 abutment
17 communication
18 passages

The invention claimed is:

1. A diaphragm pump comprising a conveyor chamber having a volume, a suction connection and a pressure connection which are both connected to the conveyor chamber, a working chamber which is filled with a hydraulic fluid, the working chamber having a volume, a device for applying an oscillating pressure $p_1$ to the hydraulic fluid, a diaphragm which separates the conveyor chamber and the working chamber from each other and which is reciprocable between a pressure stroke position and a suction stroke position, wherein the volume of the conveyor chamber in the pressure stroke position of the diaphragm is smaller than in the suction stroke position of the diaphragm, a storage chamber for accommodating hydraulic fluid at a pressure $p_2$, wherein the storage chamber and the working chamber are connected together by way of a valve having a closing portion, wherein the diaphragm is coupled to the closing portion in such a way that upon a movement of the diaphragm from the pressure stroke position into a position which is further away from the suction stroke position than the pressure stroke position the valve is opened, wherein there is provided a tie rod fixed to the diaphragm, wherein the closing portion is connected to the tie rod, wherein the closing portion is moveably fixed to the tie rod so that the closing portion can be reciprocated relative to the tie rod between two positions which are such that in the pressure stroke position of the diaphragm when the closing portion is in a first position the valve is closed and in a second position of the closing portion the valve is opened, characterised in that the closing portion is resiliently biased into the first position and the resilient biasing of the closing portion is of such a magnitude that, when $p_2-p_1>a$ applies for a pressure difference between a pressure in the storage chamber and a pressure in the working chamber, wherein a is a predetermined pressure, the closing portion is moved from the first position towards the second position and the valve is opened.

2. A diaphragm pump as set forth in claim 1 characterised in that the working chamber is arranged in a housing, wherein the housing has a wall element with a valve seat.

3. A diaphragm pump as set forth in claim 2 wherein the wall element is arranged moveably in an opening in the housing and characterised in that the wall element is resiliently biased towards the housing opening.

4. A diaphragm pump as set forth in claim 3 characterised in that the resilient biasing of the wall element is of such a magnitude that, when $P_1-P_2>b$ applies for the pressure difference between the pressure in the working chamber and the pressure in the storage chamber, wherein b is a predetermined pressure, the wall element moves away from the closing portion and as a result the valve opens.

5. A diaphragm pump as set forth in claim 2, wherein the wall element is arranged moveably in an opening in the housing.

6. A diaphragm pump as set forth in claim 3, wherein arranged in the opening is an abutment element towards which the wall element is resiliently biased.

7. A diaphragm pump comprising a conveyor chamber having a volume, a suction connection and a pressure connection which are both connected to the conveyor chamber, a working chamber which is filled with a hydraulic fluid, the working chamber having a volume, a device for applying an oscillating pressure $p_1$ to the hydraulic fluid, a diaphragm which separates the conveyor chamber and the working chamber from each other and which is reciprocable between a pressure stroke position and a suction stroke position, wherein the volume of the conveyor chamber in the pressure stroke position of the diaphragm is smaller than in the suction stroke position of the diaphragm, a storage chamber for accommodating hydraulic fluid at a pressure $p_2$, wherein the storage chamber and the working chamber are connected together by way of a valve having a closing portion, wherein the diaphragm is coupled to the closing portion in such a way that upon a movement of the diaphragm from the pressure stroke position into a position which is further away from the suction stroke position than the pressure stroke position the valve is opened, wherein there is provided a tie rod fixed to the diaphragm, wherein the closing portion is connected to the tie rod, wherein the closing portion is moveably fixed to the tie rod so that the closing portion can be reciprocated relative to the tie rod between two positions which are such that in the pressure stroke position of the diaphragm when the closing portion is in a first position the valve is closed and in a second position of the closing portion the valve is opened, characterised in that the closing portion is resiliently biased into the first position and the resilient biasing of the closing portion is of such a magnitude that, when $p_2-p_1>a$ applies for a pressure difference between a pressure in the storage chamber and a pressure in the working chamber, wherein a is a predetermined pressure, the closing portion is moved from the first position towards the second position and the valve is opened;

the working chamber being arranged in a housing, wherein the housing has a wall element with a valve seat wherein the wall element is arranged moveably in an opening in the housing, the wall element being resiliently biased towards the housing opening.

8. A diaphragm pump as set forth in claim 7 characterised in that the resilient biasing of the wall element is of such a magnitude that, when $P_1-P_2>b$ applies for the pressure difference between the pressure in the working chamber and the pressure in the storage chamber, wherein b is a predetermined pressure, the wall element moves away from the closing portion and as a result the valve opens.

9. A diaphragm pump as set forth in claim 7, wherein arranged in the opening is an abutment element towards which the wall element is resiliently biased.

* * * * *